United States Patent [19]

Jung

[11] Patent Number: 4,864,475

[45] Date of Patent: Sep. 5, 1989

[54] RAINBOW LIGHT BOX

[76] Inventor: Hae-Ryong Jung, 6006 Springhill Dr. #304, Greenbelt, Md. 20770

[21] Appl. No.: 314,876

[22] Filed: Feb. 24, 1989

[51] Int. Cl.[4] ..... F21V 9/00

[52] U.S. Cl. ..... 362/231; 362/225; 362/256; 362/293; 362/812; 40/572; 40/581

[58] Field of Search ..... 362/255, 221, 222, 224, 362/225, 231, 234, 252, 253, 260, 293, 806, 812, 256; 40/572, 581

[56] References Cited

U.S. PATENT DOCUMENTS 2,175,072 10/1939 Wompey ..... 362/812 X 2,689,422 9/1954 Hoff ..... 40/581

*Primary Examiner*—Stephen F. Husar

[57] ABSTRACT

A colorful illuminated sign construction utilizing plurality of fluorescent lamp covered by colored transparent plastic thin wall tubing which is tightly enclosed by a diffusion panel sleeve so that neighboring colors can be melted each other on the diffusing panel, and it forms a colorful stipes to attract attention. The fluorescent lamps and color sleeves are held by openings installed on side frame posts at the both end of fluorescent lamp whereby heat generated at the both end of fluorescent lamp can escape to surrounded air, and the side frame posts are connected to horizontal conduit and connecting bar which forms a structural frame of sign. Side frame post covers are protecting electrical wiring therein.

5 Claims, 2 Drawing Sheets

RAINBOW LIGHT BOX

BACKGROUND OF THE INVENTION

This invention relates to illuminated sign device which is characterized by its variety of colors and its color combination from diffusing effect.

Illuminated signs having multiple colors are utilized in commercial field to attract the attentions of passersby, neon sign, for example, is widely used in sign industries because of its beautiful illuminated color characteristics. However, neon sign has several drawbacks. First, neon sign is expensive. Second, neon sign is fragile. Third, neon sign utilizes only one face, which means illuminated indicia is shown in mirror image when it is oberved from the wrong side. Fourth, neon sign can not draw any attention unless it is lighted. Fifth, neon sign require high voltage which therefore need special insulation to prevent current leaking.

To overcome above mentioned drawbacks while obtaining more attractive and colorful illuminated sign, inexpensive and widely available fluorescent lamps and diffusing panel are utilized in the present invention.

OBJECT OF THE INVENTION

Therefore, it is an object of the present invention to provide an illuminated sign characterized by its variety of colors.

Another object is to provide a colorful illuminated sign creating mixed color effect by diffusion.

Another object is to provide a colorful illuminated sign which is inexpensive.

Another object is to provide a colorful illuminated sign which can be operated by comparatively low voltage.

Another object is to provide a colorful illuminated sign which can be used as a sign even when it is not lighted.

Another object is to provide a colorful illuminated sign which can utilize both faces.

SUMMARY OF THE INVENTION

The present colorful illuminated sign apparatus comprises a diffusing panel housing enclosing a plurality of colored transparent thin wall plastic sleeves covered over fluorescent light bulbs. The light emitted by the fluorescent light bulbs is passed through the color sleeves for filtration of specific wave length of light wave, and diffused by the diffusing panel. The diffusing panel is situated right next to the color sleeves whereby a mixture of neighboring colors are created.

In general, this lighting box can be used simply to attract attention of passers-by with its colorfulness. More preferably, indicia and/or graphic designs may be added on to the both sides of the diffusing panel to serve its full purpose as a sign. Further, by attaching changeable letter track on the surface of sign face, changeable letters can be slided into the track whereby a variety of messages or graphics can be displayed on the colorful background.

BRIEF DESCRIPTION OF THE DRAWING

For a better understanding of the invention, reference is made to the following description taken in connection with the accompanying drawings, in which.

DETAILED DESCRIPTION OF THE DISCLOSED EMBODIMENT

Figure 1:
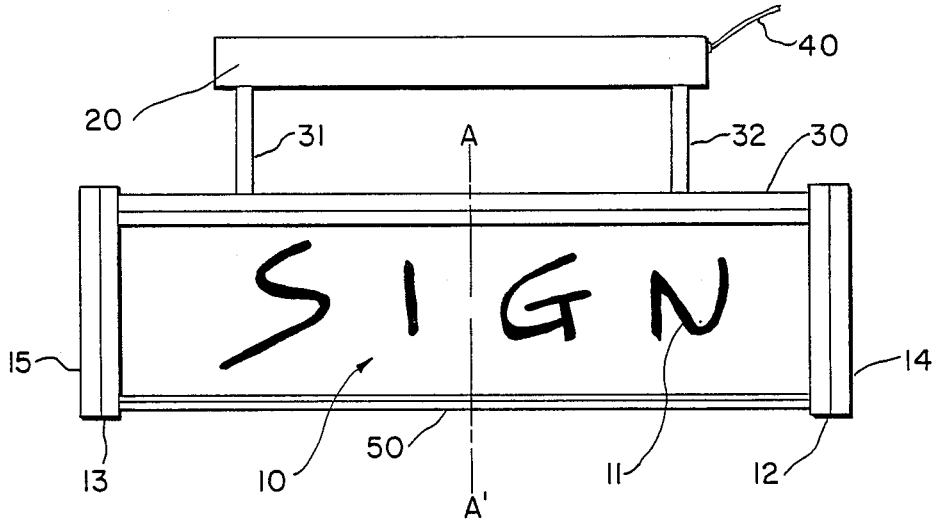
FIG. 1 is a front view of a lighting box constructed in accordance with the present invention.

Referring first to FIG. 1, a front view of the illuminated sign structure is shown. The lighting box 10 (shown in FIG. 2), color sleeves 16 (shown in FIG. 2) and fluorescent lamps 19 (shown in FIG. 3) is firmly held by side frame posts 12 and 13 which are fastened to horizontal conduit 30 and connecting rod 50 which constructs a structural frame to hold lighting box 10. Vertical conduit 31 and 32 connect the lighting box and its frame to ballast box 20. Side frame post covers 14 and 15 are fastened to the side frame posts 12 and 13 so that the covers can be opened when needed. Electrical wiring between the ballast box 20 and fluorescent lamps are enclosed by the side frame posts, side frame post covers and the horizontal, vertical conduits. Power supply cord 40 supplies regular electrical power for lighting. Indicia 11 is attached on the surface of diffusing panel sleeve 17.

Figure 2:
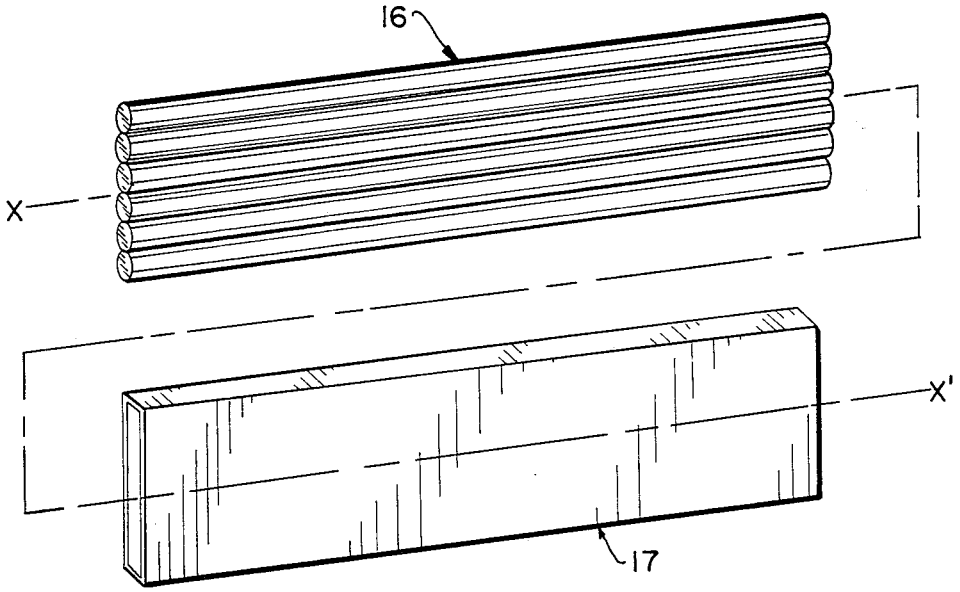
FIG. 2 shows a group of color sleeves which fit inside of the lighting box along the X-X′ axis.

FIG. 2 shows a plurality of color sleeves 16 which are colored transparent plastic thin wall tubings. These plurality of tubings are glued together and it fits into a diffusing panel sleeve 17. The diffusing panel sleeve 17 is preferablly made of white or translucent diffusing panel with or without patterns depending on the application. The pattern may be prismatic or cracked ice pattern both of which are widely available in the market. When transparent panel is utilized, the panel should have some kind of macroscopic diffusing capability caused by refraction of light. Examples of such panel are transparent acrylic or polystyrene panels with prismatic pattern or cracked ice pattern.

Figure 3:
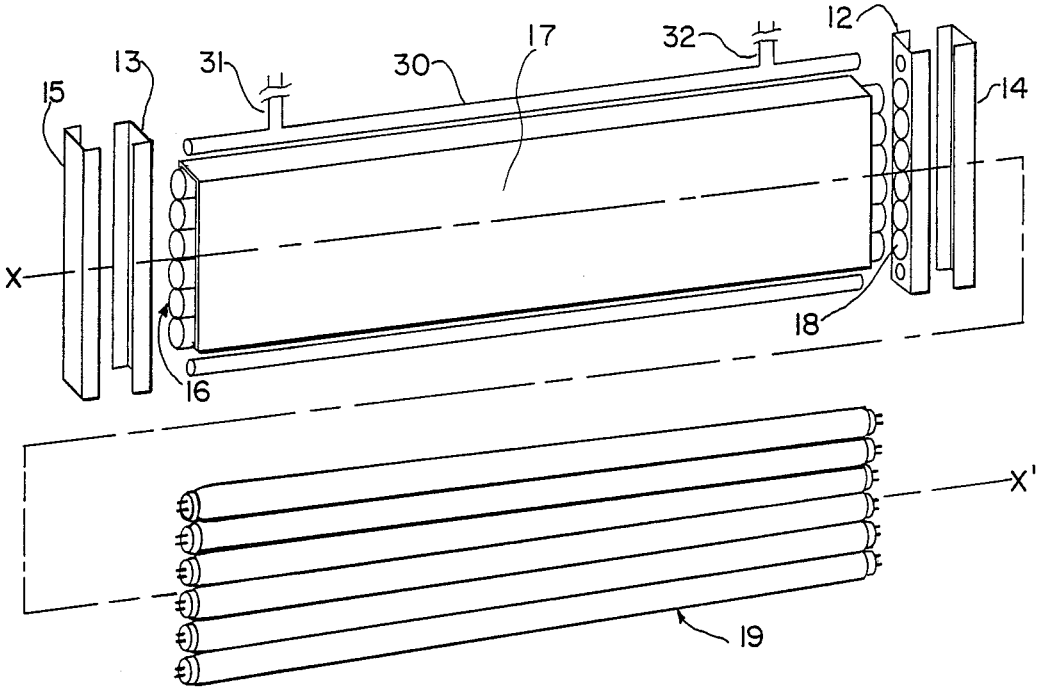
FIG. 3 is a more specific diagram showing the lighting box embodying the present invention.

FIG. 3 is a more specific diagram showing the invention. A group of fluorescent light bulbs 19 fits into the color sleeves 16 along the axis shown as X-X′. The color sleeves are transparent plastic (preferablly polycarbonate) color tubing each of which has distinct color and transparency such as a product named ARM-A-LITE developed by Thermoplastics Processes, Inc. Each fluorescent light bulbs are detached from each other although the drawing illustrates the group as if they are attached to one another.

After color sleeve 16 is inserted into diffusing panel sleeve 17 along the axis X-X′ as shown in FIG. 3, same number of fluorescent lamp 19 is inserted into the said color sleeve along with the same axis X-X′. Side frame post 12 and 13 has opening 18 which receives the end of color sleeve 16 at both ends. Since fluorescent light bulb is longer than color sleeve, the fluorescent lamp pin 41 will be accessible for electrical connection to the insulated electrical conductors between side frame post and side frame post cover at both ends. Weight of the fluorescent lamp 19, color sleeve 16 and diffusing panel sleeve 17 is firmly held by the opening 18 installed on the side frame post 12 and 13 as shown in the FIG. 3. Consequently, regular fluorescent lamp holder is not needed. However, electrical connection to the fluorescent lamp pin is required to operate the lamp lighting as regular lighting fixtures.

In connecting the fluorescent lamp pins 41, to necessary wiring, socket terminals (part #60619-1 and

#1-480349-0 developed by AMP Products Corporation) are utilized (not shown in the drawings). In general, the wiring adopted in the present invention is well known conventional wiring scheme that it is not necessary to include all the details in describing the invention.

Once all the components described above are assembled together, a lighting box shown in FIG. 1 is formed. When electrical power is supplied to the power supply cord 40, the fluorescent lamps start emitting lights from fluorescent material coated inside wall of the lamp tubes.

Figure 4:
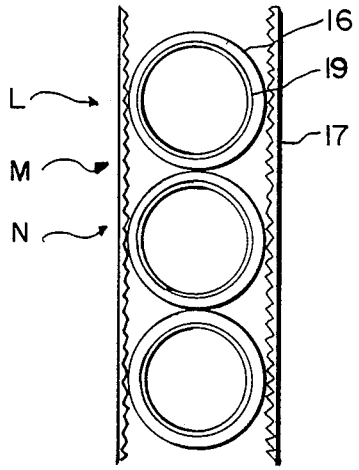
FIG. 4 is a sectional view taken along the A-A′ axis of the front view shown in FIG. 1.

Turning now to FIG. 4, a sectional view of a part of the lighting box of FIG. 1 taken along the A-A' axis is shown. The lights emitted from the fluorescent lamp is filtered by color sleeve 16, and remaining wave length of the light is diffused in the diffusing panel sleeve 17. If all different color sleeves are neighboring each other, gradual color mixture is appeared on the diffusing panel. For example, the color at the areas designated by letter "L" and "N" are close to the original colors of the sleeves while the area "M" show a mixed color of two adjacent colors. The mixing ratio of two adjacent colors in between the area "L" and "N" is gradually different so that one color melts into an adjacent color which creates smooth color stripes. As a result, a combination of colorful stripes are observed on the diffusing panel sleeve.

A combination of fluorescent lighting and diffusing panel is well known in lighting fixture industry and lighted sign industry. However, the purpose of diffusion in the present invention is totally different from prevailing art. For example, in the prior art lighting fixtures, it is essential to lower the brightness (number of lumen per unit area) while maintaining the total brightness (total number of lumen) of light source. This requires light energy to be spread out as wide as possible to decrease a strong stimulation to human visual system. For this purpose, diffusing panel is adopted for lighting fixture. In sign industry, it is essential to have lighted background with even brightness on which sign indicia can be added.

To obtain these spreading effect by diffusing, all of these application in the lighting fixture and lighted sign require certain distance between the light source and diffusing panel, and this results in an unavoidable limitation in reducing the thickness of lighting fixture and lighted sign which creates inconvenience as to display the sign in the show window. In the contrary, in this invention, it is necessary to place diffusing panel as close as possible to light source to obtain the color mixture as described previously.

An other reason that the diffusing panel should be as close as possible to the light source is to prevent multicolor mixture which results in a colorlessness. As shown in FIG. 4, color mixture is allowed only between neighboring colors by blocking the second neighboring colors and further colors from chance of mixing. Therefore, an extraordinarily thin and colorful lighting box is formed.

On the surface of the diffusing panel sleeve, messages and/or graphic disigns may be added to serve a full purpose of a sign. For addition of inidia, cut vinyl film, molded plastic letters or flat-cut letters may be used. Furthermore, by attaching letter track on the surface of diffusing panel, changeable letters can be slided in for specific messages. When translucent film or plastic panel is applied as sign indicia, light goes through one more filtration of a specific color which creates even more colorful combination on the indicia.

Since many different color fluorescent lamp bulb is available, a further variety of color combination is easily obtainable by replacing the fluorescent lamp when it is needed. Combining all of these color factors illustrated above, limitless variety of color effect can be observed on the panel which is used to draw attention of passersby as a sign as well as endless artistic creations.

Turning now back to the structure of the sign, the side frame posts 12 and 13 are made of metal which has a high heat conductivity, such as aluminum, so that the heat generated by electron impact on the electrode at the end part of fluorescent lamp bulb can escape easily to surrounded air through the metal frame posts. Side frame post covers 14 and 15 also have heat sinking function because they are fastened to the side frame posts tightly.

It will thus be seen that the object set forth above, among those made apparent from the preceding description, are effeciently attained. Also, it is intended that all matter contained in the above discription or shown in the accopanying drawings shall be interpreted as illustrative and not in a limiting sense.

What is claimed:

1. A colorful illuminated sign apparatus comprising;

a ballast box, a plurality of fluorescent light bulbs wired properly to said ballast box for power supply, a plurality of color sleeves each of which contains each of said plurality of fluorescent light bulbs to provide colorful stripes of light, a diffusing sleeve enclosing said plurality of color sleeves wherein a colorful lighting box is formed when switch is on as a result of diffusion.

2. A colorful illuminated sign apparatus as claimed in claim 1, further comprising;

a pair of side frame posts with number of openings for supporting said plurality of color sleeves containing fluorescent light bulbs, a pair of side frame post covers firmly attached to said side frame posts for electrical wiring therein, a rod connecting bottom part of said pair of side frame posts, a conduit connecting upper parts of said pair of side frame posts.

3. A colorful illuminated sign apparatus as claimed in claim 1, further comprising indicia on said diffusing sleeve.

4. A colorful illuminated sign apparatus as claimed in claim 1, wherein said diffusing sleeve is made of prismatic panel.

5. A colorful illuminated sign apparatus as claimed in claim 1, wherein said diffusing sleeve is made of translucent panel.

* * * * *